US006365273B1

(12) United States Patent
Baillievier

(10) Patent No.: US 6,365,273 B1
(45) Date of Patent: Apr. 2, 2002

(54) COMPACT CORD

(75) Inventor: Freddy Baillievier, Zwevegem (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 07/913,718

(22) Filed: Jul. 16, 1992

Related U.S. Application Data

(63) Continuation of application No. 07/463,139, filed on Jan. 10, 1990, now abandoned.

(30) Foreign Application Priority Data

Feb. 6, 1989 (EP) ..... 89200259

(51) Int. Cl.[7] ..... B32B 15/00; D02G 3/02

(52) U.S. Cl. ..... 428/379; 428/364; 428/375; 428/377; 428/378; 428/389; 57/200; 57/210; 57/212

(58) Field of Search ..... 428/364, 373, 428/377, 379, 389; 57/200, 210, 212, 902

(56) References Cited

U.S. PATENT DOCUMENTS 4,332,131 A * 6/1982 Palsky et al. ..... 57/213
4,627,229 A * 12/1986 Bourgois ..... 57/213
4,651,513 A * 3/1987 Dambre ..... 57/217
4,783,955 A * 11/1988 Uchio ..... 57/213

FOREIGN PATENT DOCUMENTS

GB 1466114 * 3/1977

* cited by examiner

*Primary Examiner*—Cynthia H. Kelly
*Assistant Examiner*—J. M. Gray
(74) *Attorney, Agent, or Firm*—Foley & Lardner

(57) ABSTRACT

The invention relates to a cord comprising a core structure and one layer, said core structure consisting of 1 to 4 core filaments (1) having a diameter $d_1$, $d_1$, being greater than 0.15 mm and smaller than 0.40 mm, said layer consisting of n+m layer filaments (2) having a diameter $d_2$ and being twisted in the same direction and at the same pitch as the core filaments (1) of said core, $d_2$ being greater than or equal to $d_1$–0.05 mm and being smaller than or equal to $d_1$–0.015 mm, n being equal to the number of core filaments (1) and m being equal to six if n is greater than one and being equal to five if n is equal to one, whereby the core filaments (1) are visually different from the layer filaments (2).

19 Claims, 2 Drawing Sheets

COMPACT CORD

This application is a continuation, of application Ser. No. 07/463,139, filed Jan. 10, 1990, now abandoned.

The present invention relates to a cord comprising a core structure and one layer. Said core structure consists of 1 to 4 core filaments having a diameter $d_1$, $d_1$ being greater than 0.15 mm and smaller than 0.40 mm, said layer consists of n+m layer filaments having a diameter $d_2$ and being twisted in the same direction and at the same pitch as the core filaments of said core, $d_2$ being greater than or equal to $d_1$−0.05 mm and being smaller than or equal to $d_1$−0.015 mm, n being equal to the number of core filaments and m being equal to six if n is greater than one and being equal to five if n is equal to one. The present invention also relates to a rubber article, and more particularly a tire and a breaker layer of a tire comprising a cord as described hereabove.

It is well known that cords, especially steel cords, may be used for reinforcement of rubber articles. Such steel cords conveniently, but not exclusively, comprise steel filaments having a carbon content of more than 0.60% carbon, e.g. more than 0.68%, or more than 0.81%. A typical steel composition is: a minimum carbon content above 0.65%, a manganese content between 0.40% and 0.70%, a silicon content between 0.15% and 0.30%. The sulphur and phosphor contents are preferably kept below 0.03%. Other, more expensive elements such as chromium may also be alloyed. The elongation at rupture of steel filaments used for rubber reinforcement preferably lies above 1%, most preferably above 2.5%. These steel filaments conveniently have a tensile strength above 2200 $N/mm^2$, preferably above 2700 $N/mm^2$.

Compact cords occupy a special place among the cords. All the filaments of these cords, with exception of a possible wrapping filament, are twisted in the same direction and at the same pitch. These compact cords have several highly appreciated advantages. They are manufactured in one single step as is explained in the UK Patent Application GB-A-2 028 393. So cost of manufacturing is low. Another advantage is that the filaments composing the compact cords have line contacts with each other. This reduces fretting. And as the name itself suggests, compact cords have a high compactness, i.e. their cross-sections have compact configurations having a maximum of filled surface per occupied cross-sectional surface. However, compact cords have the drawback of a risk of core migration, especially when these cords are used in the breaker of a tire.

One well known solution to avoid core migration is to use different diameters for the filaments: the core structure of the compact cords consists of 1 to 4 filaments having a diameter $d_1$ which is 0.015 to 0.05 mm greater than the diameter $d_2$ of the other filaments forming a layer surrounding the core structure. If the difference between the two diameters is smaller than 0.015 mm, then the risk for core migration becomes greater. If the difference between the two diameters is greater than 0.05 mm then the degree of compactness decreases.

This solution has proved to be a good solution to prevent core migration but only in case of correct filament location, i.e. if the thicker filaments (diameter $d_1$) form the core structure, and the thinner filaments (diameter $d_2$) form the layer. If there is a bad filament location the risk of core migration still remains. This bad filament location may be caused by an erroneous exchange of spools by the labourer in the unwinding unit of the twisting machine or by an alternation in the filament position during the twisting process.

The small difference in diameter (0.015–0.05 mm) between the core and the layer filaments is not sufficient to be detected with the naked eye. Hence, checking whether the filament location of a twisted compact cord is correct, is a manual and time-consuming job. Furthermore, the checked sample is no longer usable: A sample of 1 m cord is cut from a bobbin. The labourer disentangles the different filaments of this sample manually and looks for the core filaments. The core filaments are different from the layer filaments in that their deformation degree is lower due to a lower distance from the imaginary axis of the cord. Once the core filaments are identified their diameters are measured manually with a micrometer. The result is subsequently noted down. The time needed for one such measurement varies from 2 to 2.5 minutes. If the application of the cord is critical, e.g. if the cord is to be used as a breaker reinforcement of a tire, such measurement is needed per winding unit (e.g. per 16 kg bobbin).

This costly and time-consuming check detects possible erroneous exchanges of spools in the unwinding unit but does not guarantee a 100% correct filament location over the whole length of the cord.

It is an object of the present invention to avoid the drawbacks of the prior art. It is a further object of the present invention to provide a compact cord, the time needed for checking the filament location of said compact cord being minimized.

According to a first aspect of the present invention there is provided a cord comprising a core structure and one layer, aid core structure consisting of 1 to 4 core filaments having a diameter $d_1$, $d_1$ being greater than 0.15 mm and smaller than 0.40 mm, said layer consisting of n+m layer filaments having a diameter $d_2$ and being twisted in the same direction and at the same pitch as the core filaments of said core, $d_2$ being greater than or equal to $d_1$−0.05 mm and being smaller than or equal to $d_1$−0.015 mm, n being equal to the number of core filaments and m being equal to six if n is greater than one and being equal to five if n is equal to one characterized in that the core filaments have a surface which is visually different from the surface of layer filaments. The cord may or may not be surrounded by a single wrapping filament. Visually different means that it is detectable with the naked, unaided eye of a person with ordinary visual capacities. A substantially different colour is a visual difference.

The visual difference of the different categories of filaments may be realized in several ways. In the case of steel cord used for the reinforcement of rubber articles all the filaments are conveniently coated with a brass alloy in order to provide the necessary rubber adhesion. One way to make the visual difference is to avoid coating the core filaments with a brass alloy or any other metal or alloy, while still coating the layer filaments with a brass alloy or with copper. The difference in colour between the naked core filaments and the brass-coated layer filaments is more than sufficient to be detected with the naked eye of the labourer. Another way is to coat the core filaments with zinc, aluminium, cobalt, tin, magnesium or nickel, and to coat the layer filaments with a brass alloy. Among these zinc is appreciated as a coating of the core filaments since it has acceptable drawing properties. The core filaments may also be coated with copper, but the visual difference with the layer filaments which are brass-coated is not that great.

A third way may be to surround a thin coloured nylon fiber around the core filaments and not around the layer filaments. In this case the core filaments may be coated with brass too.

It is clear that with a cord according to the first aspect of the present invention the time-consuming check of the filament location becomes superfluous and that a visual check lasting only some instants is sufficient. It is also clear that a bad filament location over a limited distance due to an alternation in the filament position during the twisting process may easily be discovered too. The check may also be automatized.

According to a second aspect of the present invention there is provided a rubber article comprising a cord according to the first aspect of the present invention. The cord according to the first aspect of the present invention is preferably used in one or more breaker layers of a tire.

Different embodiments of the present invention will now be described with reference to the accompanying drawings wherein FIGS. 1 to 4 represent cross-sectional views of compact cords according to the first aspect of the present invention;

FIG. 5 represents a cross-sectional view of a tire comprising a cord according to the first aspect of the present invention.

FIG. 1 represents an embodiment where there is one core filament 1 and six layer filaments 2. The cross-sections of the layer filaments 2 are shaded, which means that they are coated with a conventional brass coating. The cross-section of core filament 1 is not shaded: core filament 1 may be coated with zinc.

Figure 1:
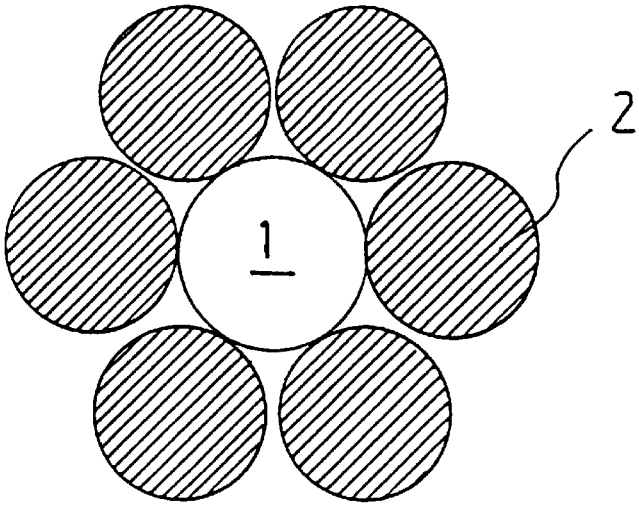
Figure 2:
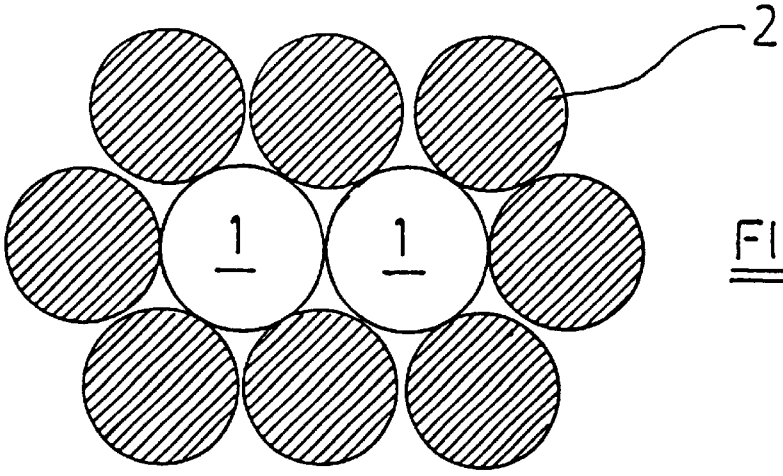
FIG. 2 represents a second embodiment where there are two core filaments 1 and eight layer filaments 2.
Figure 3:
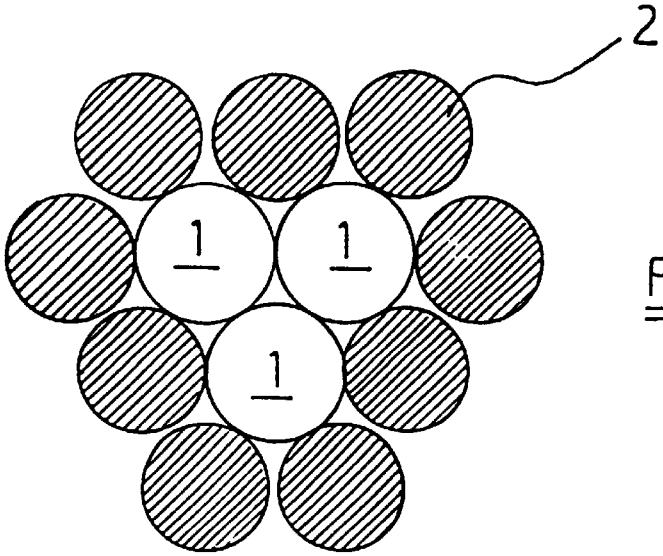
FIG. 3 represents a third and preferred embodiment where there are three core filaments 1 and nine layer filaments 2.
Figure 4:
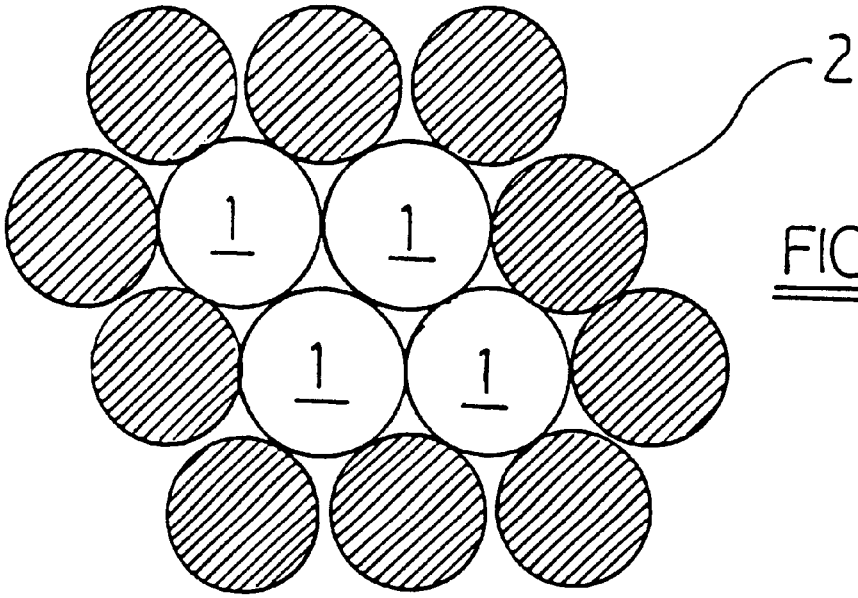
FIG. 4 represents a fourth embodiment where there are four core filaments 1 and ten layer filaments 2.
Figure 5:
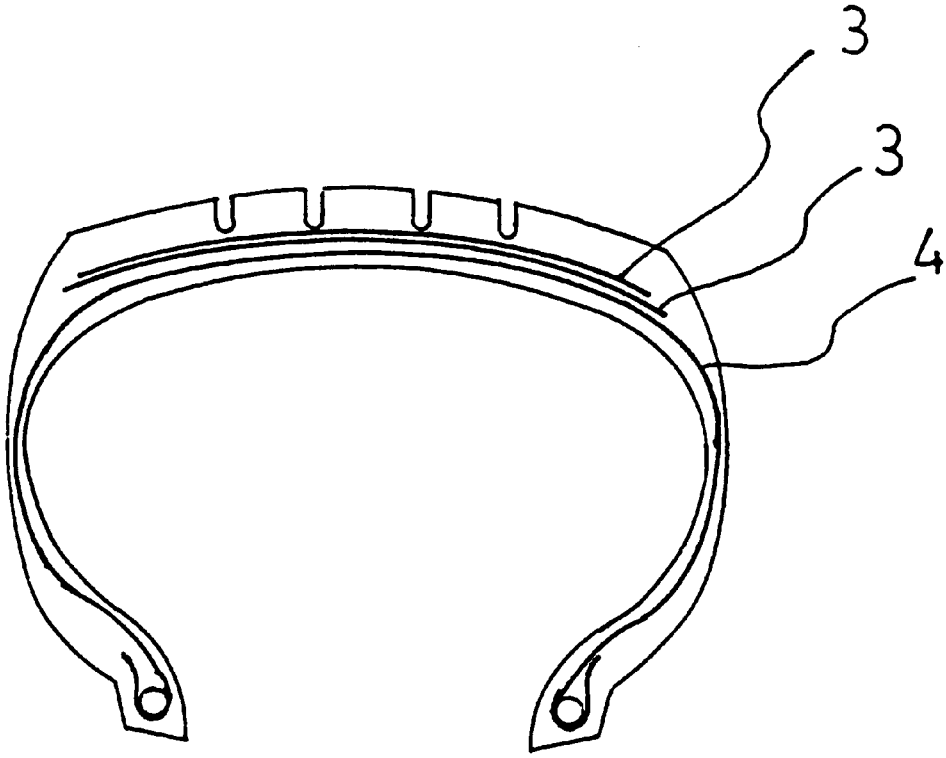

FIG. 5 represents a truck tire having breaker layers 3 and a carcass layer 4. The cord according to the first aspect of the present invention is preferably used in the breaker layers 3 but may also be used as reinforcement for the carcass layer 4.

The cord according to the first aspect of the present invention may be manufactured in substantially the same way as the steel cord of European patent application EP 0 290 082 of applicant. In order to be used as a reinforcement of a truck tire the cords are firstly impregnated in an adhesion rubber composition. Such adhesion rubber will conveniently comprise 40 to 70 parts of carbon black per 100 parts of rubber, 2 to 6 parts of coumarone resin, 4 to 12 parts of zinc oxide and 1 to 5 of sulphur, and further not more than 10 parts in total of antioxidant or accelerator or other agents, all parts being parts by weight. The cords are subsequently introduced in an unvulcanized rubber composition and the whole is vulcanized. Then they are laid side by side to form a foil of one or more superposed layers of cords and this foil is covered on either side with a foil of unvulcanized adhesion rubber which enters between and the result is a strip of cord pieces, lying side by side in one or more superposed layers, and impregnated with unvulcanized adhesion rubber.

What is claimed is:

1. A cord having a structure which facilitates visual detection of core filament mislocation, comprising of:

a core structure consisting of 1 to 4 core filaments, said core filaments having a first diameter greater than 0.15 mm and less than 0.40 mm;

one single layer consisting of n+m layer filaments, said layer filaments having a diameter of at least the first diameter of the core filaments minus 0.05 mm and no greater than the first diameter of the core filaments minus 0.015 mm, n being equal to the number of core filaments and m being equal to six if n is greater than one and being equal to five if n is equal to one;

said layer filaments and said core filaments being twisted in a same direction and at a same pitch; and wherein a surface of said core filaments is visually different from a surface of said layer filaments so that said surfaces can be visually differentiated by the naked, unaided eye of a person with ordinary visual capacities and a determination made if core mislocation has occurred or not.

2. A cord according to claim 1, wherein a surface of said core filaments has a color which is substantially different from the color of a surface of said layer filaments.

3. A cord according to claim 2, wherein the cord is a steel cord.

4. A cord according to claim 3, wherein said layer filaments are coated with a copper alloy while said core filaments remain uncoated.

5. A cord according to claim 3, wherein said layer filaments are coated with a brass alloy and wherein said core filaments are coated with an element selected from the group consisting of zinc, aluminum, cobalt, tin, magnesium and nickel.

6. A cord according to claim 3, wherein the core filaments are surrounded by a colored nylon fiber.

7. A cord according to claim 2, wherein a number of core filaments is 1 and a number of layer filaments is 6.

8. A cord according to claim 2, wherein a number of core filaments is 2 and a number of layer filaments is 8.

9. A cord according to claim 2, wherein a number of core filaments is 3 and a number of layer filaments is 9.

10. A cord according to claim 2, wherein a number of core filaments is 4 and a number of layer filaments is 10.

11. A cord according to claim 1, wherein a number of core filaments is 1 and a number of layer filaments is 6.

12. A cord according to claim 1, wherein a number of core filaments is 2 and a number of layer filaments is 8.

13. A cord according to claim 1, wherein a number of core filaments is 3 and a number of layer filaments is 9.

14. A cord according to claim 1, wherein a number of core filaments is 4 and a number of layer filaments is 10.

15. A cord as recited in claim 1, wherein said one single layer surrounds said core structure and defines an outer surface of the cord.

16. A cord having a structure which facilitates visual detection of core filament mislocation consisting of a core structure, one single layer and one wrapping filament surrounding said layer;

said core structure consisting of 1 to 4 core filaments, said core filaments having a first diameter greater than 0.15 mm and less than 0.40 mm;

said layer consisting of n+m layer filaments, n being equal to the number of core filaments, and m being equal to six if n is greater than one and being equal to five if n is equal to one;

said layer filaments having a diameter of at least the first diameter of the core filaments minus 0.05 mm and no greater than the first diameter of the core filaments minus 0.015 mm;

said layer filaments and said core filaments being twisted in a same direction and at a same pitch; and wherein a surface of said core filaments is visually different from a surface of said layer filaments so that said surfaces can be visually differentiated by the naked, unaided eye of a person with ordinary visual capacities and it can be determined if core filament mislocation has occurred.

17. A cord which facilitates visual determination of core filament mislocation and which comprising:

a core structure, one single layer and one wrapping filament surrounding said layer;

said core structure consisting of 1 to 4 core filaments, said core filaments having a first diameter greater than 0.15 mm and less than 0.40 mm;

said layer consisting of n+m layer filaments, n being equal to the number of core filaments, and m being equal to six if n is greater than one and being equal to five if n is equal to one;

said layer filaments having a diameter of at least the first diameter of the core filaments minus 0.05 mm and no greater than the first diameter of the core filaments minus 0.015 mm;

said layer filaments and said core filaments being twisted in a same direction and at a same pitch; and surface characteristic means for visually ascertaining, quickly and on-line during manufacturing of the core, whether core migration has occurred and that a core filament location is incorrect by visually differentiating a presence of a surface of a core filament amongst said layer filaments using a naked, unaided eye of a person with ordinary visual capacities.

18. A cord having a structure which facilitates visual inspection for core filament mislocation during manufacture of the cord, comprising:

a cord structure consisting of 1 to 4 core filaments, said core filaments having a first diameter greater than 0.15 mm and less than 0.40 mm;

one single layer consisting of n+m layer filaments, said layer filaments having a second diameter of at least the first diameter of the core filaments minus 0.05 mm and no greater than the first diameter of the core filaments minus 0.015 mm, n being equal to the number of core filaments and m being equal to six if n is greater than one and being equal to five if n is equal to one;

said layer filaments an said core filaments being twisted in a same direction and at a same pitch; and surface characteristic means for visually ascertaining, quickly and on-line during manufacturing of the core, whether core migration has occurred and a core filament location is incorrect by visually differentiating a presence of a surface of a core filament amongst said layer filaments using a naked, unaided eye of a person with ordinary visual capacities.

19. A cord comprising a structure which facilitates visual inspection and determination of core filament mislocation, comprising:

a core structure consisting of a first plurality of filaments;

a first visually ascertainable surface characteristic provided on the first filaments;

an external layer which is formed directly on the core structure and which consists of a second plurality of filaments; and a second visually ascertainable surface characteristic visibly different from the first visually ascertainable surface characteristic of the filaments of the core, provided on the second filaments, a difference between the first and second visually ascertainable surface characteristics being selected to be sufficient to permit an observer to detect core filament mislocation by visually inspecting a surface of the core structure and determining the presence of the first visually ascertainable characteristics thereon.

* * * * *